US010808461B2

(12) United States Patent
Slaughter, Jr.

(10) Patent No.: US 10,808,461 B2
(45) Date of Patent: Oct. 20, 2020

(54) ANGULAR OFFSET DRILLING TOOL

(71) Applicant: The Charles Machine Works, Inc., Perry, OK (US)

(72) Inventor: Greg L. Slaughter, Jr., Perry, OK (US)

(73) Assignee: The Charles Machine Works, Inc., Perry, OK (US)

( * ) Notice: Subject to any disclaimer, the term of this patent is extended or adjusted under 35 U.S.C. 154(b) by 301 days.

(21) Appl. No.: 15/799,329

(22) Filed: Oct. 31, 2017

(65) Prior Publication Data

US 2018/0119494 A1 May 3, 2018

Related U.S. Application Data

(60) Provisional application No. 62/415,618, filed on Nov. 1, 2016.

(51) Int. Cl.
*E21B 7/06* (2006.01)
*E21B 7/04* (2006.01)

(52) U.S. Cl.
CPC ..... *E21B 7/067* (2013.01); *E21B 7/046* (2013.01)

(58) Field of Classification Search
CPC ..... E21B 7/046; E21B 7/067; E21B 17/046; E21B 17/05
See application file for complete search history.

(56) References Cited

U.S. PATENT DOCUMENTS 959,378 A 5/1910 O'Neill et al.
2,402,238 A * 6/1946 Carpenter ..... E21B 7/06 175/256
2,680,005 A * 6/1954 Storm ..... E21B 7/06 175/256
2,779,570 A * 1/1957 Roper ..... E21B 7/061 464/19
3,301,581 A * 1/1967 Winberg ..... E21B 17/046 403/379.4
3,457,999 A * 7/1969 Massey ..... E21B 7/067 175/61
4,077,657 A * 3/1978 Trzeciak ..... E21B 7/067 175/256
4,446,932 A * 5/1984 Hipp ..... E21B 7/067 175/61
5,101,914 A 4/1992 Wenzel
5,314,032 A 5/1994 Pringle et al.
(Continued)

FOREIGN PATENT DOCUMENTS

CA 2278804 A1 7/1998

*Primary Examiner* — Shane Bomar

(74) *Attorney, Agent, or Firm* — Tomlinson McKinstry, P.C.

(57) ABSTRACT

An angular offset tool for directionally drilling an underground borehole is formed from a collar, a housing, and a wedge. The collar and the housing are joined by a ball-and-socket connection. An internal wedge is situated between the collar and the housing within the ball-and-socket connection such that the collar and housing are joined at a non-straight angle. At least one of the collar and the housing has a recess formed in an element of the ball-and-socket connection. The wedge is situated in the recess in contacting relationship with the collar and the housing. The wedge and the housing have interlocking features that prevent rotation of the wedge within the recess.

16 Claims, 8 Drawing Sheets

(56) References Cited

U.S. PATENT DOCUMENTS

| | | | | |
|---|---|---|---|---|
| 5,343,966 | A | 9/1994 | Wenzel et al. | |
| 5,490,569 | A | 2/1996 | Brotherton et al. | |
| RE39,970 | E | 1/2008 | Askew | |
| 8,033,917 | B2 * | 10/2011 | Prill | E21B 4/02 464/18 |
| 8,157,025 | B2 | 4/2012 | Johnson | |
| 2012/0013339 | A1 * | 1/2012 | Kuckes | E21B 47/02216 324/346 |
| 2014/0027185 | A1 * | 1/2014 | Menger | E21B 7/067 175/73 |
| 2015/0300098 | A1 * | 10/2015 | Logan | E21B 17/042 166/237 |

* cited by examiner

ANGULAR OFFSET DRILLING TOOL

FIELD

The present invention relates to tools and methods for directionally drilling an underground borehole.

SUMMARY

A sub for an underground drill string is formed from a tubular collar, a housing, and a wedge. The collar has opposed first and second ends, a socket, and an internal shoulder. Positioned adjacent the first end, the socket is bounded by the internal shoulder. The housing has a passage extending therethrough, an end, and an internal shoulder. The end is positioned within the socket of the collar. The internal shoulder is positioned adjacent the end. Situated between the collar and the housing in contacting relationship with each internal shoulder, the wedge has a passage extending therethrough.

A kit is formed from a tubular collar, a housing, and a wedge. The collar has an end, a socket, and an internal shoulder. Positioned adjacent the end, the socket is bounded by the internal shoulder. The housing has a passage extending therethrough, an end, and an internal shoulder positioned adjacent the end. The wedge has a passage extending therethrough. A selected one of the collar and the housing has an internal recess. The wedge is configured to be at least partially received in interlocking relationship within the recess.

A system is formed from an underground drill string having a plurality of interconnected and threaded string components terminating in a drilling tool. One of the string components comprises a sub. The sub has an internal wedge and a pair of tubular sub sections. Each sub section has an internal shoulder contacting the wedge. The sub sections are joined by a ball-and-socket connection frozen at a predetermined non-straight central angle.

DETAILED DESCRIPTION

In horizontal directional drilling operations, a bend formed in a drill string may be used for steering. The drill string is typically a dual-member drill string having inner and outer drill string components. In such a system, a bent sub may be incorporated in the outer drill string to create the steering feature. The presently disclosed invention is directed toward a sub having two tubular sub members joined at a fixed bend in a ball-and-socket joint.

Figure 1:
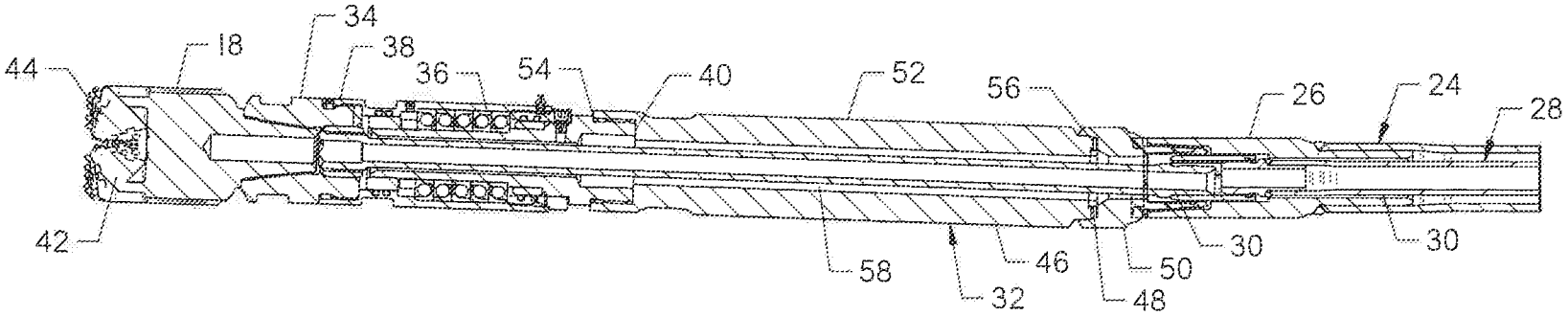
FIG. 1 is a partial cross-sectional side view of a portion of a dual-member drill string having a sub.
Figure 2:
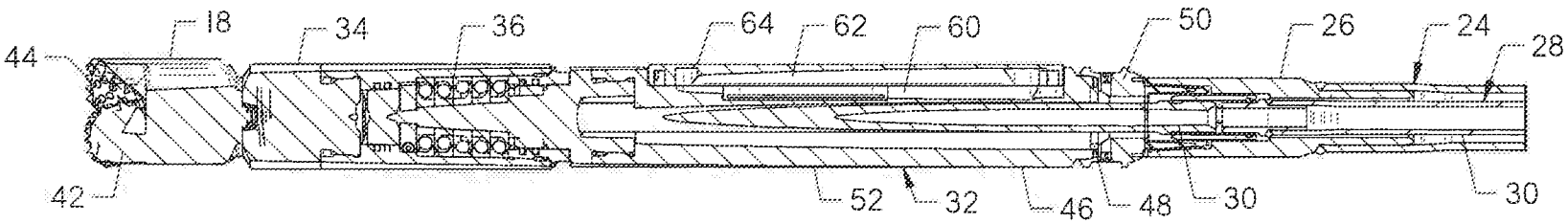
FIG. 2 is a partial cross-sectional side view of the portion of the dual-member drill string of FIG. 1. The drill string has been rotated to show a cavity formed in the sub and a beacon situated in the cavity.
Figure 9:
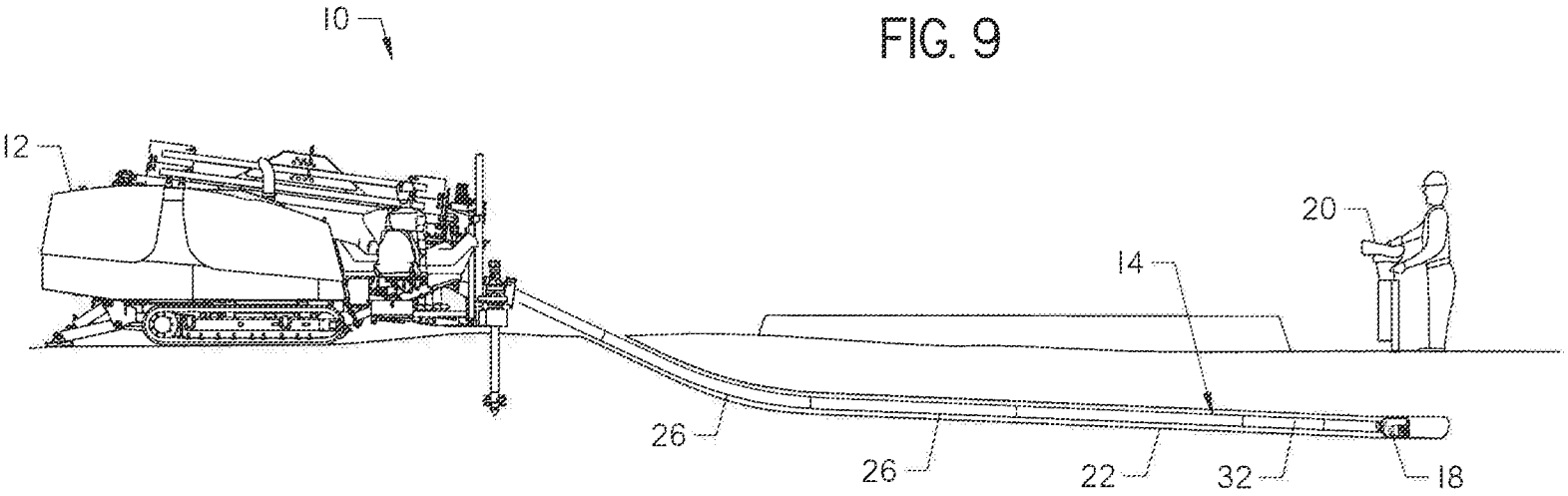
FIG. 9 is a side elevation view of a horizontal directional drilling operation in which a dual-member drill string is used to drill a borehole.

FIG. 9 illustrates a horizontal directional drilling system to comprising a drilling rig 12, a dual-member drill string 14, a drill bit 18, a tracker 20, and a borehole 22. With reference to FIGS. 1 and 2, the dual-member drill string 14 comprises an outer drill string 24 formed from a plurality of adjacent outer pipe members 26 and an inner drill string 28 formed from a plurality of adjacent inner pipe members 30. Dual-member drill strings, such as drill string 14, allow independent rotation of the outer drill string 24 and the inner drill string 28 such that rotation of each component drill string 24, 28 may perform a separate function. In such a configuration, the outer drill string 24 may provide for steering of the drill string 14 while the inner drill string 28 may rotate the drill bit 18.

Figure 8:
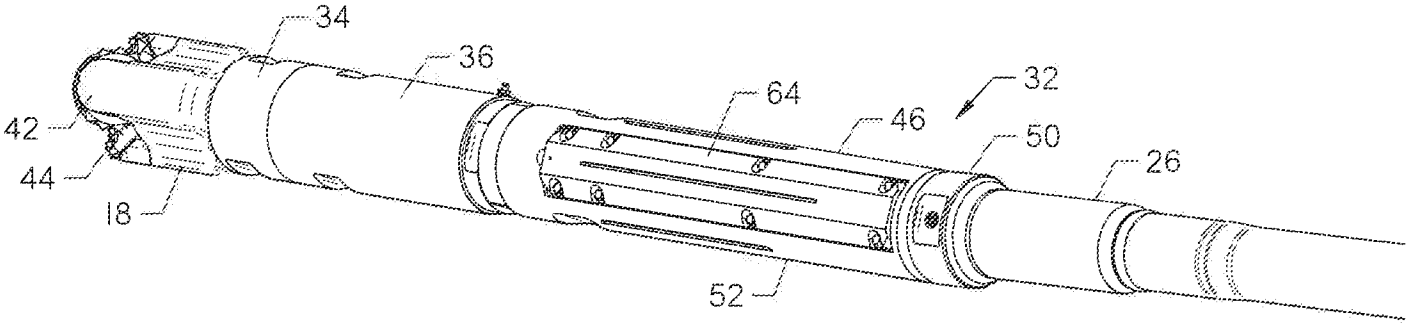
FIG. 8 is a perspective view of a portion of the drill string of FIG. 1.

Shown in FIGS. 1, 2, and 8 is a portion of a dual-member drill string 14 having a sub assembly 32 positioned between the drill bit 18 and one of the outer pipe members 26. The inner drill string 28 extends through the outer pipe member 26 and the sub assembly 32. The inner drill string 28 connects to a drill bit base 34 on which the drill bit 18 is mounted. A bearing assembly 36 has a first end 38 connected to the drill bit base 34 and a second end 40 connected to the sub assembly 32. The bearing assembly 36 supports the inner drill string 28 such that the inner drill string 28 and its attached drill bit 18 are rotatable relative to the outer drill string 24.

The drill bit 18 comprises a plurality of rotary cutting cones 42. Each cutting cone 42 carries a plurality of cutting elements 44. The cutting elements 44 are formed from a strong and durable material, such as a carbide material or a polycrystalline diamond compact material. In embodiments, the drill string 14 may carry any suitable drilling tool, including a slant-faced bit, a reamer, or a hammer.

The sub assembly 32 includes a housing 46, a wedge 48, and a collar 50. The housing 46 is formed from a strong and durable material such as steel. The housing 46 has a tubular body 52 having opposed first and second ends 54, 56 and an internal passage 58. As shown in FIG. 2, the housing 46 has a cavity 60 configured to carry a magnetic dipole source, such as an electronic beacon 62. An electrically transparent cover 64 is positioned over the cavity 60. The electrically transparent cover 64 permits signal from the beacon 62 to travel through the cover 64 to the above-ground tracker 20.

Figure 3:
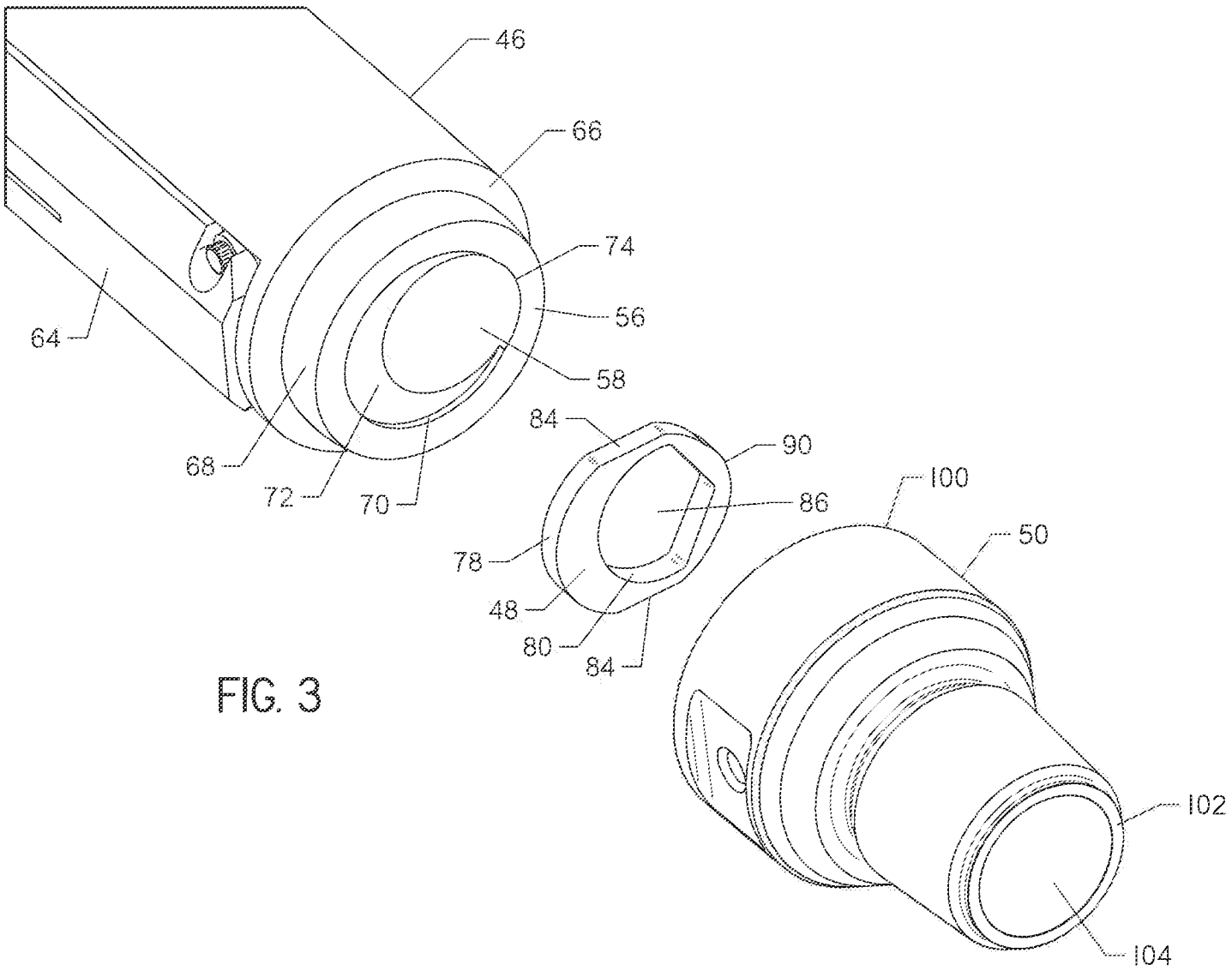
FIG. 3 is a perspective view of an end of a housing, a wedge, and a collar of the sub of FIG. 1.
Figure 4:
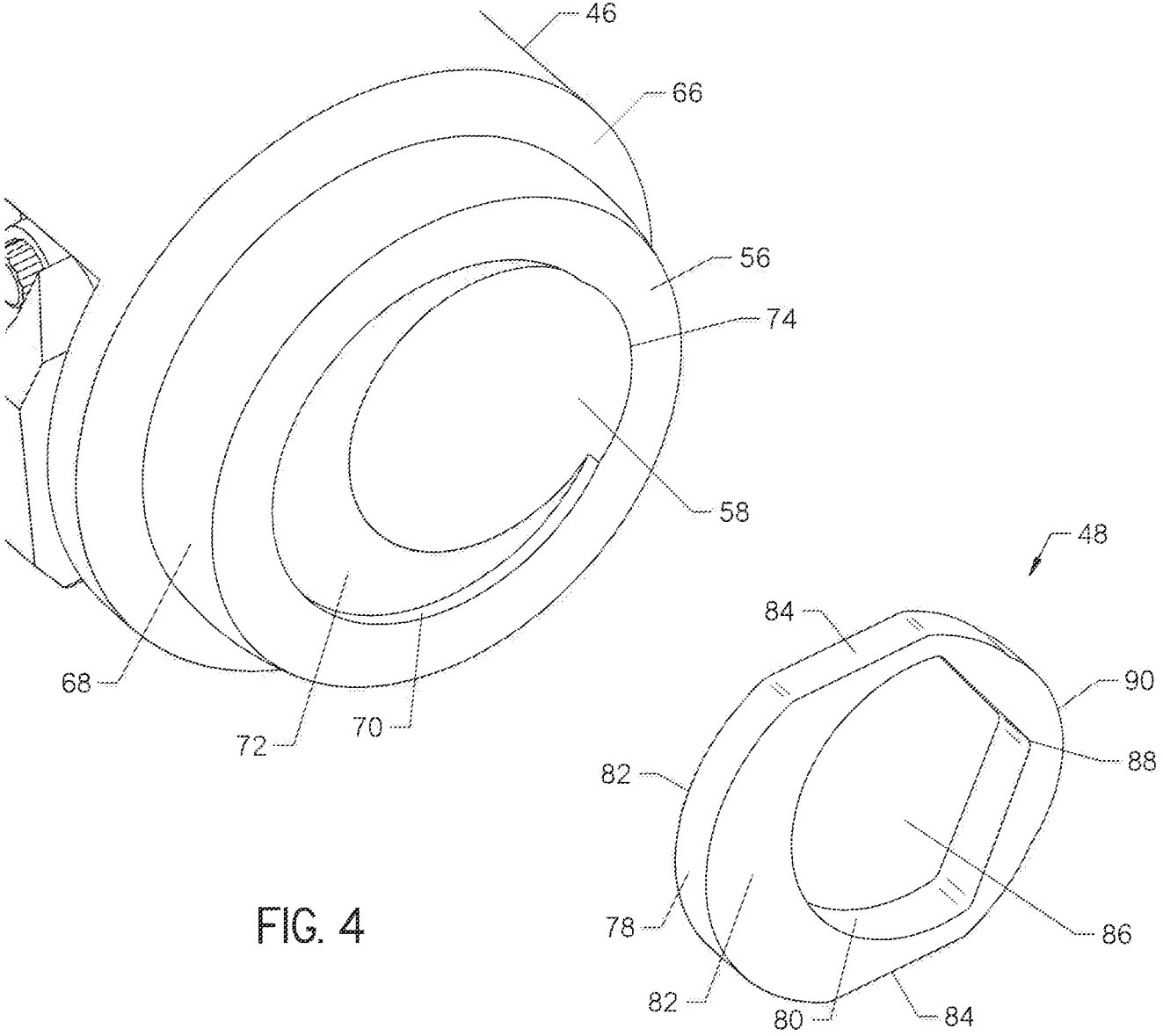
FIG. 4 is an enlarged perspective view of the end of the housing and the wedge of FIG. 3.

As best shown in FIG. 3, the internal passage 58 may be offset from the longitudinal axis of the housing 46 such that the passage 58 and the housing 46 are not concentric. Offsetting the passage 58 provides space for the beacon 62 in the housing wall and facilitates routing the inner drill string 28 through the bend in the assembled sub assembly 32. In embodiments, the internal passage 58 and the housing 46 may be concentric.

Figure 5:
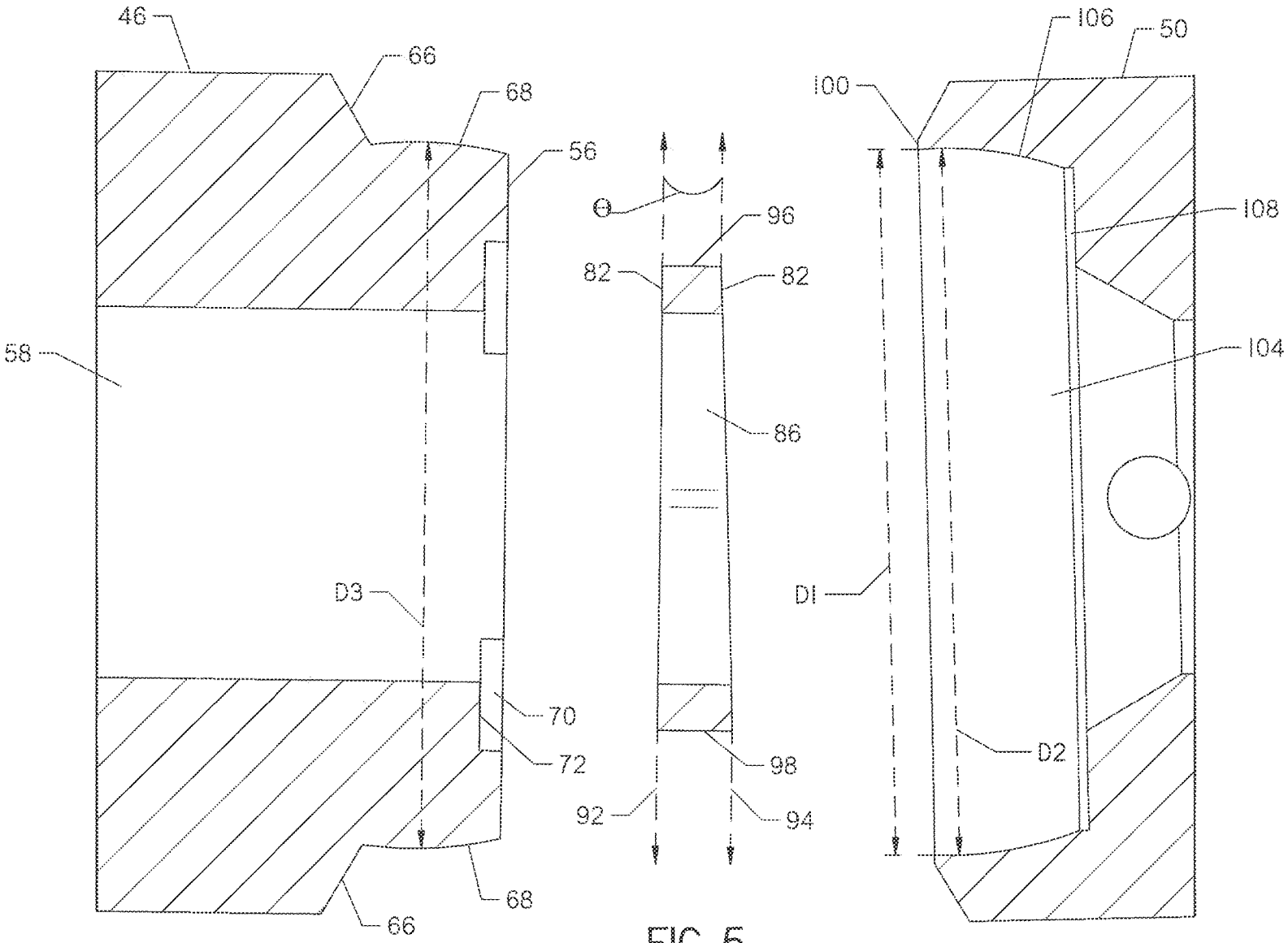
FIG. 5 is a cross-sectional side view of a portion of the housing, the wedge, and a portion of the collar of FIG. 3.
Figure 6:
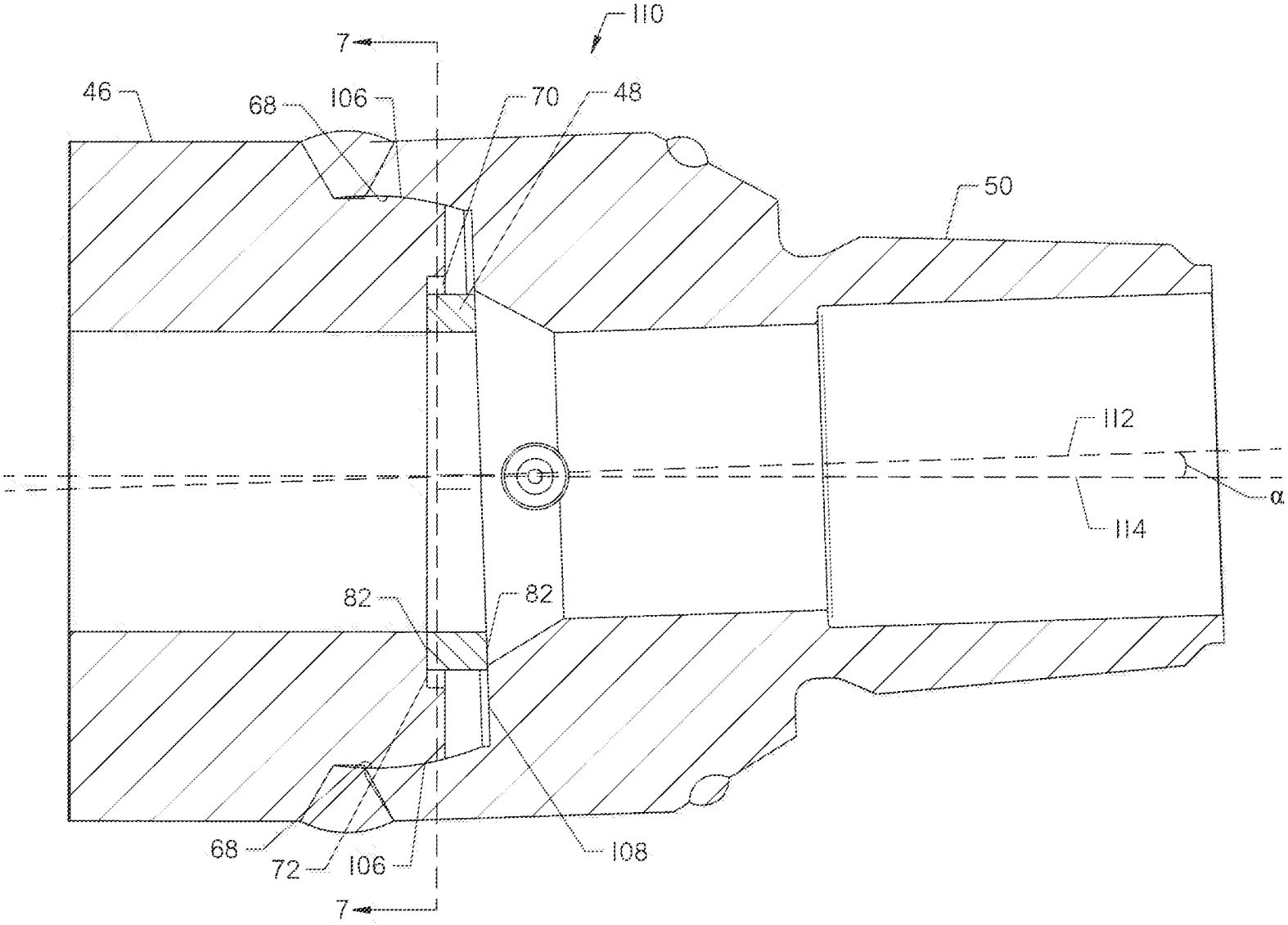
FIG. 6 is a cross-sectional view of the assembled housing, wedge and collar of FIG. 3.
Figure 7:
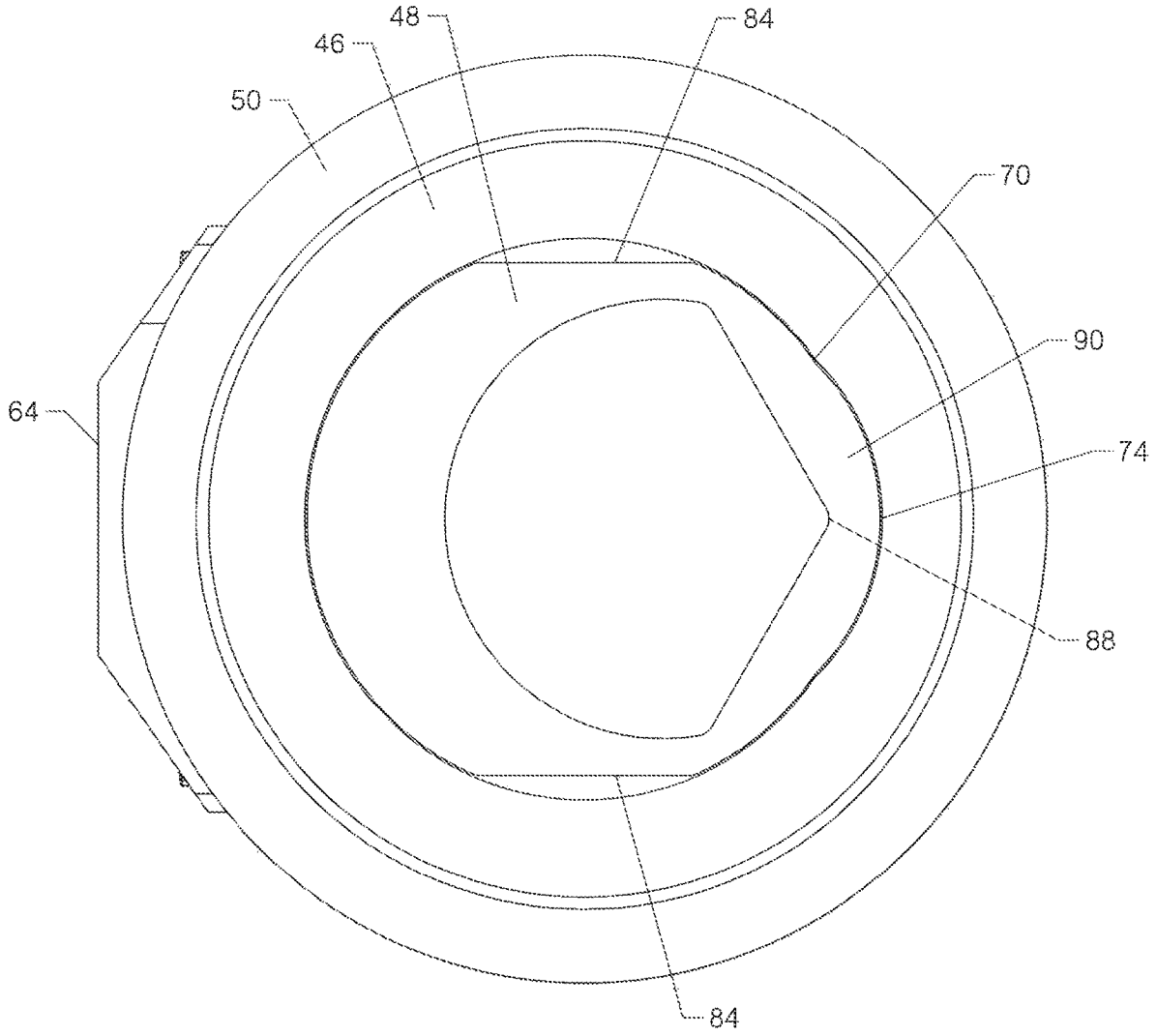
FIG. 7 is a cross-sectional view of the assembled housing, wedge, and collar of FIG. 6 taken along line 7-7.

With reference to FIGS. 3-7, the housing 46 has an external shoulder 66 and a ball section 68 adjacent the second end 56. A recess 70 formed in the ball section 68 is bounded by an internal shoulder 72. The cross-sectional profile of the recess 70 may have any suitable shape, including the shape of a circle or a polygon. As shown in FIG. 7, the recess 70 has a non-circular shape characterized by a notch 74.

The wedge 48 is formed from a strong and durable material, such as steel. The cross-sectional profile of the wedge 48 may have any suitable shape, including the shape of a circle or a polygon. As shown in FIG. 7, the wedge 48 has a non-circular shape characterized by an outer protrusion 90. Such a feature allows the wedge 48 and the housing 46 to interlock when the protrusion 90 of the wedge 48 is situated within the notch 74 of the housing 46. In embodiments, the wedge 48 and the housing 46 may be configured to interlock by inserting a pin into a pair of aligned holes formed in the wedge 48 and the housing 46. In such a configuration, the pin has opposed ends received in the aligned holes in order to prevent rotation of the wedge 48 relative to the housing 46.

The wedge 48 has an outer surface 78, an inner surface 80, and a pair of opposed sides 82. The outer surface 78 may be characterized by a plurality of flat surfaces 84. The flat surfaces 84 may be arranged in opposing relationship on the outer surface 78.

The inner surface 80 defines a passage 86 extending through the wedge 48 between the sides 82. The inner surface 80 may feature a notch 88. The notch 88 is situated to provide clearance for the inner drill string 28 passing through the passage 86.

With reference to FIG. 5, the opposed sides 82 of the wedge 48 are situated on non-parallel planes 92, 94 such that the wedge 48 slopes from a thinner portion 96 to a thicker portion 98. The non-parallel planes 92, 94 form an included angle θ of between one-half and four degrees. Preferably, the included angle θ is two degrees.

The collar 50 is formed from a strong and durable material, such as steel. The collar 50 has opposed first and second ends 100, 102 and an internal passage 104 extending between the ends 100, 102. Adjacent the first end 100, a socket 106 is bounded by an internal shoulder 108 formed in the collar 50.

At the first end 100 of the collar 50, the passage 104 in the collar 50 has a maximum cross-sectional dimension D1, as shown in FIG. 5. Within the socket 106, the passage 104 of the collar 50 has a maximum cross-sectional dimension D2. The ball section 68 of the housing 46 has a maximum cross-sectional dimension D3. Preferably, the dimension D1 is less than the dimension D2. Also preferably, the dimension D3 is larger than the dimension D1. Such a configuration enables the ball section 68 of the housing 46 to be retained in the socket 106 of the collar 50 in an interference fit.

Shown in FIGS. 6 and 7 is an assembled ball-and-socket joint 110 of the sub assembly 32. To assemble the ball-and-socket joint 110, the wedge 48 is placed in the recess 70 of the housing 46. The wedge 48 is oriented so that the protrusion 90 in the wedge 48 is situated within the notch 74 in the housing 46. For ease in manipulating the orientation of the wedge 48, the user may grasp the wedge's flat surfaces 84. While carrying the wedge 48 within the recess 70, the ball section 68 of the housing 46 is pressed into the socket 106 of the collar 50 in an interference fit relationship. After assembly, the housing 46 and the collar 50 may be welded together to further secure the joint 110.

Once the ball-and-socket joint 110 is assembled, axial movement of the wedge 48 is restrained by the sides 82 of the wedge 48 contacting the internal shoulder 72 of the housing 46 and the internal shoulder 108 of the collar 50. Rotational movement of the wedge 48 is restrained by the protrusion 90 of the wedge 48 contacting the notch 74 in the recess 70 of the housing 46.

By utilizing the wedge 48 to introduce a non-straight angle between the housing 46 and the collar 50, the bent sub 32 can be manufactured from coaxial tubular components. In the assembled sub assembly 32, the collar 50 is situated on longitudinal axis 112, and the housing 46 is situated on longitudinal axis 114 as shown in FIG. 6. The longitudinal axes 112, 114 form a non-straight included angle α, which is introduced by the slope in the wedge 48. Because the wedge 48 is lodged between the internal shoulders 72, 108 and rotationally fixed in the recess 70, the wedge 48 is axially and rotationally locked within the ball-and-socket joint 110. Thus, the collar 50 and the housing 46 are frozen together in the sub assembly 32 at the non-straight angle predetermined by the slope in the wedge 48.

As illustrated in the figures, the recess 70 is formed in the housing 46. However, in embodiments, the recess 70 may be formed in the collar 50. As illustrated, the ball section 68 is a feature of the housing 46, and the socket 106 is a feature of the collar 50. In embodiments, the ball section 68 may be formed in the collar 50 and the socket 106 may be formed in the housing 46. Furthermore, in embodiments, the wedge 48 may be machined as an integral component of the housing 46 or the collar 50. Alternatively, the wedge 48 may be joined to the housing 46 or the collar 50 by a fusion process such as welding.

As shown in FIGS. 1, 2 and 8, the assembled sub assembly 32 is positioned between the drill bit 18 and one of the outer pipe members 26. The first end 54 of the housing 46 connects to the bearing assembly 36. The second end 102 of the collar 50 connects to the outer pipe member 26. The inner drill string 28 extends through the adjacent internal passages 58, 86, 104 of the housing 46, wedge 48, and collar 50 respectively.

In the system to of FIG. 9, the sub assembly 32 is used to steer the drill bit 18 to directionally drill the borehole 22. The drilling rig 12 rotates the inner drill string 28 and its attached drill bit 18. Simultaneously, the drilling rig 12 pushes the dual-member drill string 14 through the ground creating the borehole 22. Without rotation of the outer drill string 24, the bent sub assembly 32 deflects the path of the drill bit 18, and thus creates a curve in the borehole 22. In order to change the drilling direction, the outer drill string 24 is rotated so that the bent sub assembly 32 deflects the path of the drill bit 18 in a different direction. By rotating the outer drill string 24 at a particular constant angular velocity, the system to is able to drill in a straight line.

Changes may be made in the construction, operation and arrangement of the various parts, elements, steps and procedures described herein without departing from the spirit and scope of the invention as described in the following claims.

The invention claimed is:

1. A sub for an underground drill string, comprising:

a tubular collar having opposed first and second ends and a socket bounded by an internal shoulder and positioned adjacent the first end;

a housing having a passage extending therethrough, an end positioned within the socket of the collar, and an internal shoulder positioned adjacent the end; and a wedge situated between the collar and the housing in contacting relationship with each internal shoulder and having a passage extending, therethrough;

in which a selected one of the collar and the housing has a recess situated between its end and its internal shoulder and in which the wedge is rotationally locked within the recess.

2. The sub of claim 1 in which the internal passage of the housing is not centered about the longitudinal axis of the housing.

3. The sub of claim 1 in which the housing carries a magnetic dipole source.

4. The sub of claim 1 in which the recess has a non-circular cross-sectional profile.

5. The sub of claim 1 in which the recess is characterized by a notch and in which the wedge has an outer surface having a protrusion configured to interlock with the notch.

6. The sub of claim 1 in which the wedge has a non-circular cross-sectional profile.

7. The sub of claim 1 in which the wedge has a fully-enclosed cross-sectional profile.

8. The sub of claim 7 in which the passage formed in the wedge has a non-circular cross-sectional profile.

9. The sub of claim 1 in which a pair of alignable holes are formed in the housing and the wedge, and further comprising:

a pin having opposed ends received within the aligned holes.

10. A system, comprising:

a dual-member drill string positioned in the ground and comprising:

the sub of claim 1 in which the housing is a first outer pipe member;

a second outer pipe member having a passage extending therethrough and joined to the first outer pipe member by the collar; and an inner drill rod extending through the passages formed in the first and second outer pipe members and the wedge.

11. A kit, comprising:

a tubular collar having an end and a socket bounded by an internal shoulder and positioned adjacent the end;

a housing having a passage extending therethrough, an end, and an internal shoulder positioned adjacent the end; and a wedge having a passage extending therethrough, in which a selected one of the collar and the housing has an internal recess and in which the wedge is configured to be at least partially received in interlocking relationship within the recess; and in which the internal passage of the housing is not centered about with the longitudinal axis of the housing.

12. The kit of claim 11 in which the recess has a non-circular cross-sectional profile.

13. The kit of claim 11 in which the wedge has a fully-enclosed cross-sectional profile.

14. A kit, comprising:

a tubular collar having an end and a socket bounded by an internal shoulder and positioned adjacent the end;

a housing having a passage extending therethrough, an end, and an internal shoulder positioned adjacent the end, wherein the housing is characterized by a longitudinal axis; and a wedge having a passage extending therethrough, in which a selected one of the collar and the housing has an internal recess and in which the wedge is rotationally locked within the recess; and in which the passage of the housing is not centered about a longitudinal axis of the housing.

15. The kit of claim 14 in which the recess is characterized by a notch and in which the wedge has an outer surface having a protrusion configured to interlock with the notch.

16. The kit of claim 14 in which the wedge has a non-circular cross-sectional profile.

* * * * *